US006102655A

United States Patent [19]

Kreitmeier

[11] Patent Number: 6,102,655

[45] Date of Patent: Aug. 15, 2000

[54] SHROUD BAND FOR AN AXIAL-FLOW TURBINE

[75] Inventor: Franz Kreitmeier, Baden, Switzerland

[73] Assignee: Asea Brown Boveri AG, Baden, Switzerland

[21] Appl. No.: 09/153,270

[22] Filed: Sep. 14, 1998

[30] Foreign Application Priority Data

Sep. 19, 1997 [EP] European Pat. Off. ..... 97810686

[51] Int. Cl.[7] ..... F01D 11/08

[52] U.S. Cl. ..... 415/173.3; 415/173.5; 415/173.6; 415/173.7; 416/192

[58] Field of Search ..... 415/173.3, 173.5, 415/173.6, 173.7, 173.4; 416/191, 192

[56] References Cited

U.S. PATENT DOCUMENTS

| | | | |
|---|---|---|---|
| 885,032 | 4/1908 | Ferranti | 415/173.3 |
| 1,482,031 | 1/1924 | Parsons et al. | 415/173.6 |
| 1,708,044 | 4/1929 | Baumann | 415/173.7 |
| 2,611,532 | 9/1952 | Ljungstrom | 415/173.7 |
| 2,910,269 | 10/1959 | Haworth et al. | 415/173.6 |
| 3,314,651 | 4/1967 | Beale | 415/173.6 |
| 4,370,094 | 1/1983 | Ambrosch et al. . | |
| 4,662,820 | 5/1987 | Sasada et al. . | |
| 5,044,881 | 9/1991 | Dodd et al. | 415/173.3 |
| 5,145,316 | 9/1992 | Birch | 415/173.3 |
| 5,211,540 | 5/1993 | Evans | 416/191 |
| 5,290,144 | 3/1994 | Kreitmeier | 415/173.6 |
| 5,632,598 | 5/1997 | Maier . | |

FOREIGN PATENT DOCUMENTS

| | | | |
|---|---|---|---|
| 0536575 | 4/1993 | European Pat. Off. . | |
| 2226555 | 11/1974 | France . | |
| 2384949 | 10/1978 | France . | |
| 2032328 | 3/1971 | Germany . | |
| 3523469 | 1/1987 | Germany | 415/173.6 |
| 666326 | 7/1988 | Switzerland | 416/191 |
| 767656 | 2/1957 | United Kingdom . | |
| 933618 | 8/1963 | United Kingdom . | |
| 1008526 | 10/1965 | United Kingdom . | |

*Primary Examiner*—Christopher Verdier
*Attorney, Agent, or Firm*—Burns, Doane, Swecker & Mathis, L.L.P.

[57] ABSTRACT

In a device for sealing the gap between the moving blades and the stator, designed with a conical contour, of a turbomachine, the moving blades are provided at the blade end with encircling shroud plates. These shroud plates project into a cavity in the stator and, while forming radial gaps, make a seal against the stator, which is provided with sealing strips. The cavity at the labyrinth inlet is subdivided in its radial extent into at least two axially staggered cavities. The shroud plate is of stepped design with at least two choke points with respect to the stator, the sealing strips acting on one step each while enclosing a vortex chamber. A curved sealing strip which runs at least approximately horizontally preferably acts on each step of the shroud plate.

3 Claims, 2 Drawing Sheets

SHROUD BAND FOR AN AXIAL-FLOW TURBINE

BACKGROUND OF THE INVENTION

1. Field of the Invention

The invention relates to a device for sealing the gap between the moving blades and the casing, designed with a conical contour, of a turbomachine, the moving blades being provided with encircling shroud plates which, while forming radial gaps, make a seal against the casing, which is provided with sealing strips.

2. Discussion of Background

Such devices are known. They form a smooth or a stepped half labyrinth having entirely radial gaps. Such a seal is shown in FIG. 2, which is to be described later.

As a result of the better efficiency and the greater reliability, this type of gap seal is in the meantime already being used for the moving blades of the penultimate stage of condensing steam turbines. The mechanical requirements here, at circumferential speeds of 450 m/sec, are quite high, whereas the thermal conditions, at about 90° C., are modest. The geometrical requirements are problematic: on the one hand, on account of the pronounced conicity, which leads to deep cavities of the known sealing device in the casing wall; on the other hand, on account of the large differential expansions between rotor and casing, which lead to wide cavities with the abovementioned half labyrinths.

The large cavity formed in this case in the inlet region of the seal produces an unfavorable cross exchange of flow material with the main flow in the blade duct. This cross exchange is encouraged by the exceptionally large fluctuation of the pressure difference between two adjacent blades in the plane of the leading blade edge. In addition, a pronounced vortex is stimulated in this region by the main flow and the side wall of the shroud band.

Less effective is the half labyrinth having the sealing strips with which the casing is provided and which make a seal against the encircling shroud band. This is because, under the existing conditions, the operating clearance must have a size of about ⅓ of the free chamber height. Even a plurality of sealing strips are therefore not much more effective than a single sealing strip.

Finally, the large cavity in the outlet region of the seal also permits an undesirable cross exchange with the main flow in the blade duct, since here, too, the pressure difference between the adjacent blade tips is subjected to large fluctuations. In addition, the guidance of the main flow is completely lost in this region.

In addition, the large vortex space which is formed behind the outer sealing strip and produces considerable dissipation of the outlet-side gap flow is of disadvantage in the case of these seals.

SUMMARY OF THE INVENTION

Accordingly, one object of the invention, in the case of blades of the type mentioned at the beginning, is to provide by means of a novel shroud-band geometry a seal which, while fulfilling all the boundary conditions, leads to better efficiency.

The advantage of the invention may be seen, inter alia, in the fact that only small gap quantities occur in the case of the novel seal. In addition, the gap flow is effectively directed into the main flow.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings of the penultimate stage of an axial-flow condensing steam turbine, wherein.

DESCRIPTION OF THE PREFERRED EMBODIMENTS

Figure 1:
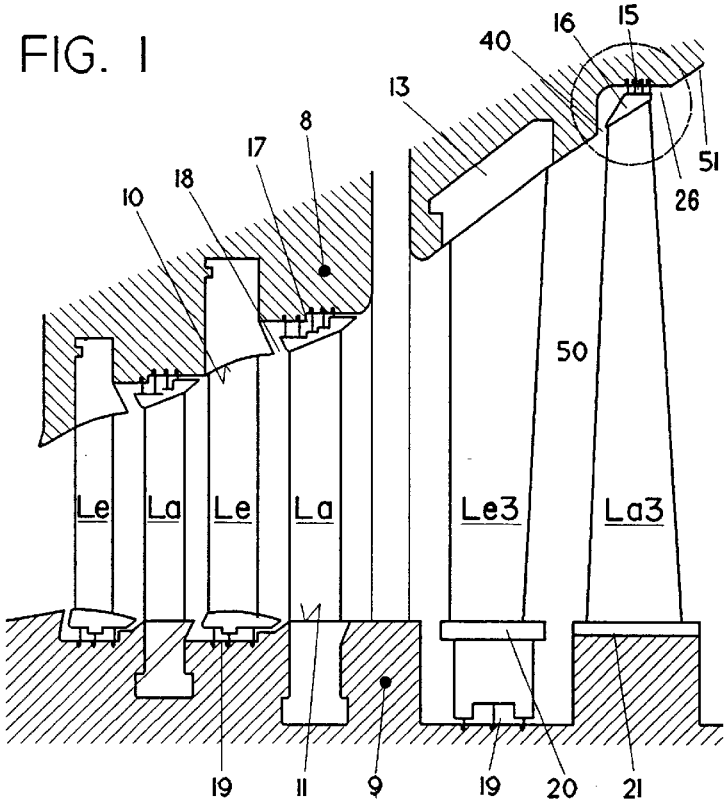
FIG. 1 shows a partial longitudinal section of a low-pressure steam turbine with shroud-plate seal.

Referring now to the drawings, wherein like reference numerals designate identical or corresponding parts throughout the several views, only the elements essential for the understanding of the invention are shown, and the direction of flow of the working medium is designated by arrows, the three center stages of low-pressure blading, which each consist of a guide row Le and a moving row La, are shown according to FIG. 1. In this case, the stage Le3/La3 corresponds to the penultimate stage. The moving blades La, which are inserted with their roots 21 into turned grooves of the rotor 9, are provided with shroud plates 16 at their blade ends. The radially outer contours of the shroud plates are of stepped design. While forming labyrinths 15, they make a seal with their steps against sealing strips which are arranged in the stator 8 in a suitable manner. The guide blades Le, which are inserted with their roots 13 into turned grooves of the stator 8, are provided with shroud plates 20 at their blade ends. While forming labyrinths 19, they also make a seal against sealing strips which are arranged in the rotor 9 in a suitable manner.

As an initial situation, the duct 50 through which flow occurs has the conically running outer contour 51 at the stator and the cylindrically running inner contour 11 at the rotor. However, neither is absolutely necessary. Irrespective of the actual profile of the walls, the outer, flow-limiting contour 10 in the region of the moving-blade body is always formed by the shroud plate 16, which faces the duct, of the moving blades La. Located directly upstream of the shroud plates 16, 20 are axial gaps 18 which constitute the labyrinth inlets 40. Located directly downstream of these shroud plates 16, 20 are radial gaps 26 which constitute the labyrinth outlets 42. As a rule, said gaps are defined on the other side by stator parts, which perform the function of directing the flow in the planes where there are no blades.

Figure 2:
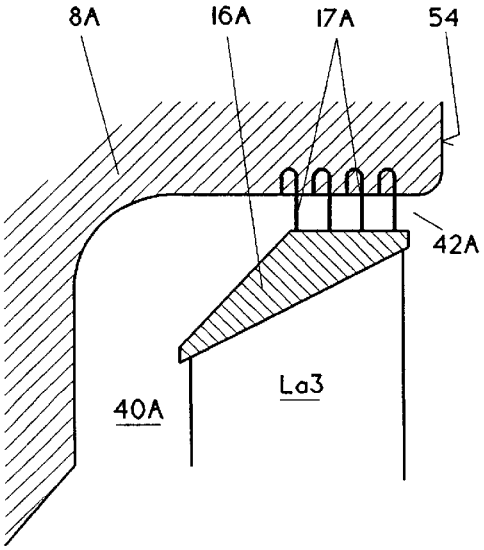
FIG. 2 PRIOR ART
FIG. 2 shows a partial longitudinal section of the moving-blade tip of the penultimate stage with shroud-plate seal according to the prior art.

The shroud-plate seal of the moving row La3, as corresponds to the prior art mentioned at the beginning, is shown in FIG. 2. It essentially comprises the shroud plate 16A, which extends over the entire blade width and, with its outside diameter and the four sealing strips 17A caulked in place in the stator 8A, forms a half labyrinth having entirely radial gaps. The labyrinth inlet 40A of large area and the labyrinth outlet 42A of unfavorable configuration can be recognized. The duct wall is designated by 54 if it leads into a bleed.

Figure 3:
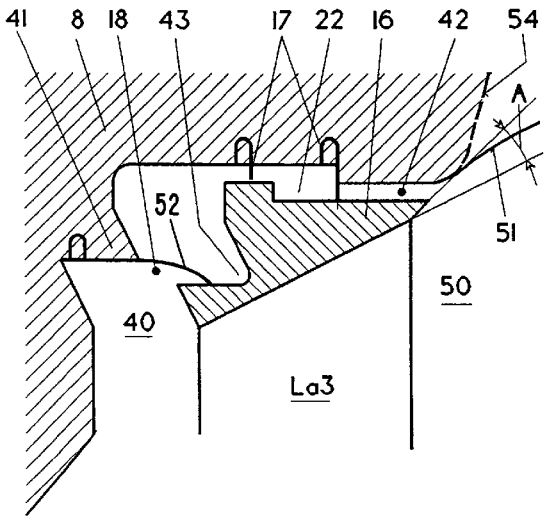
FIG. 3 shows a partial longitudinal section of the moving-blade tip of the penultimate stage with shroud-plate seal according to the invention.

As shown in FIG. 3, both the geometry of the shroud band and its embedding in the stator is now improved in a three-fold manner according to the invention.

In order to reduce the cross exchange of flow material and the vortex intensity, the radially directed cavity at the labyrinth inlet is subdivided in its radial extent into two axially staggered cavities, i.e. is of zigzag configuration in the example. To this end, the contour of the turned groove in the stator first of all runs inward into the material, then outward in the axial direction while forming a tooth 41 projecting into the cavity. The shroud plate 16 is configured in a corresponding manner. It is provided with a recess 43, which is adapted to the shape of the tooth. The axially running part of the recess is dimensioned in its diameter in such a way that shroud plate and stator do not come into contact with each other during the assembly and during operating transients. A comparison with FIG. 2 shows that, in the operating position, a substantially smaller through-gap 18 appears between stator and shroud plate. The gap mass flow is therefore considerably reduced by the novel measure.

Furthermore, the known half labyrinth is replaced by a full labyrinth. To this end, the outside diameter of the shroud plate is stepped and provided with only two choke points. Two sealing strips 17, which are calked in place in the stator and in each case act on a step, define a vortex chamber 22 which functions effectively. The choke points, due to their radial offset, do not influence one another. With this full labyrinth, a further reduction in the gap mass flow is achieved.

A third measure serves to improve the inflow of the labyrinth mass flow into the main duct again. To this end, the cavity at the labyrinth outlet 42 is reduced in the radial direction to a permissible minimum size. The gap flow is immediately received by a stator wall bent outward relative to the general conicity. The harmful cross exchange of flow material can thus be substantially reduced and the unnecessary dissipation of the highly energetic gap flow can be largely avoided. In addition, the total-pressure profile of the main flow is favorably influenced by the bent stator wall.

For this purpose, the flow-limiting wall of the duct 50 is provided with a kink angle A directly at the outlet of the moving blades La3. This kink angle is dimensioned in such a way that the outflow from the moving blades is homogenized with regard to total pressure and outflow angle. In the example, this means that the angle A shown is defined as positive. The bent wall part runs radially outward, i.e. it is directed away from the machine axis (not shown). The cross exchange of flow material, which is induced by the pressure zone, which depends on the spacing, is reduced by this design. This is because this cross exchange may be the cause of separation at the especially sensitive suction side of the blades.

The selection of the kink angle is based on the following considerations: there is a divergent flow, with associated swirl at the cylinder, at the outlet of the moving blades. At least the flow in the radially outer zone has substantially higher energy than in the radially inner rotor zone, a factor which is manifested in the form of substantially higher total pressures in the radially outer zone. With the kink-angle idea, it is now necessary to achieve the lowest possible total-pressure and outflow-angle inhomogeneity over the blade height. The equation for the radial equilibrium teaches that this can be achieved primarily via the meridian curvature of the flow lines. This must therefore be influenced primarily by adaptation of the kink angle. A homogeneous total-pressure distribution at the outer boundary wall can only be achieved if the corresponding kink angle A relative to the conical contour of the duct always opens outward. In this case, the desired total-pressure reduction in this region is achieved.

Accurate directing of the flow over a certain region is required in order to fully realize this kink-angle idea. This is done from the knowledge that the flow inhomogeneities originating from the blade circulation slowly disappear only at a distance which corresponds to half the distance between moving-blade outlet and guide-blade inlet divided by the blade spacing.

The wall further upstream, at least approximately in the inlet region of the guide blades of the following stage (not shown), is expediently provided with a kink angle B directed radially inward.

The wall provided with this kink angle B, in the root region of the guide blade situated upstream, runs radially inward again following the opposite kink angle, so that the resulting flow-limiting wall, which is interrupted between guide-blade root and subsequent moving-blade shroud plate by the axial gap 18, has a common point P with the original straight duct contour at least approximately in the plane of the moving-blade inlet of this following stage. These facts are illustrated in FIG. 3 with reference to that wall which is located upstream of the cavity and which may possibly be the flow-limiting part of the guide-blade root situated at the front.

The opposite kink angle at the upstream wall increases the negative pressure or reduces the positive pressure over the downstream labyrinth, a factor which leads to a further reduction in the gap mass flow.

In the exemplary embodiments explained below, the elements having the same function are provided with the same reference numerals as in FIG. 3.

Figure 4:
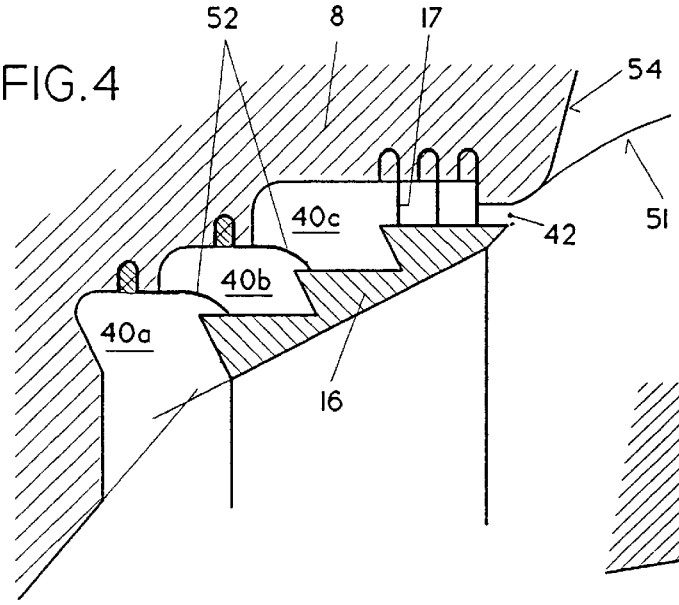
FIGS. 4 and 5 show a partial longitudinal section of the moving-blade tip of the penultimate stage with a shroud-plate embodiment variant.

FIG. 4 shows a solution in which the shroud band has the same conicity of about 25° as that in FIGS. 2 and 3. The cavity at the labyrinth inlet is subdivided in its radial extent into three axially staggered cavities 40*a*, 40*b* and 40*c*. Three sealing strips 17 calked in place in the stator are arranged at the labyrinth outlet.

Here, too, in order to improve the inflow of the labyrinth mass flow into the main duct again, the cavity at the labyrinth outlet 42, directly behind the last sealing strip, is reduced in the radial direction to a permissible minimum size. As a rule, this minimum size is also provided in the front cavities. To this end, the shroud plate 16 is of stepped design. The individual cavities are sealed with sealing strips 52 which run approximately horizontally in their first section and are then curved. These sealing strips 52 are preferably caulked in place with their horizontally running section in the axially running casing parts. It goes without saying that other fastening methods and geometries are also possible.

FIG. 4 shows the shroud plate in the normal operating position. The front sealing strips 52 act on the front edges of the horizontally directed shroud-plate steps. The rear sealing strips 17 act on the last horizontally directed shroud-plate step.

Figure 5:
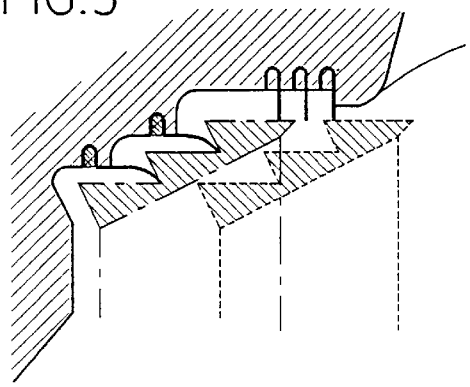

In FIG. 5, on a somewhat reduced scale, the shroud plate is shown in its extreme positions, namely during transients, as occur during the start-up and shutdown of the machine. It can be seen that, in the position shown by chain-dotted lines, the sealing strips 52 engage at the intersection between axially and radially directed step parts. In order to facilitate this, inter alia, the radial step part is designed to slope against the direction of flow. In addition, the curvature of the sealing strips permits problem-free escape in the event of the shroud plate assuming an even more extreme position. Furthermore, in this position, the frontmost sealing strip 17 makes a seal against the horizontally directed, rear shroud-plate part. In the position shown by dashes the sealing strips 52 are no longer in engagement. Here, only the last sealing strip 17 makes a seal and thus prevents working medium from flowing through the gap 42 in an uncontrolled manner.

Figure 6:
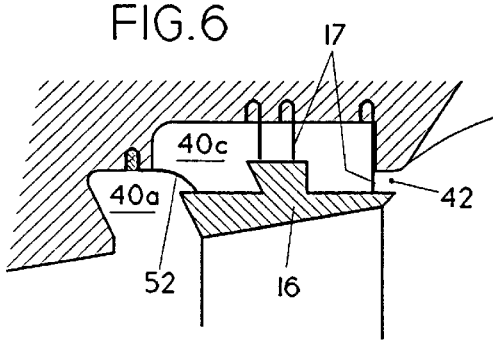
FIG. 6 shows a partial longitudinal section of the moving-blade tip of a stage having slight conicity with a shroud-plate embodiment variant.

FIG. 6 shows the novel solution in the case of a shroud plate having a conicity of only about 10°, as is used in front stages of low-pressure parts of steam turbines. Here, the cavity is subdivided into two sectional cavities 40*a* and 40*c*. These sectional cavities are separated by a sealing strip 52 which runs approximately horizontally in its first section and is then curved. This strip acts on a shroud plate 16 which has a single step. The other sealing strips 17 are arranged in such a way that at least one of the strips 52 or 17 is effective even in extreme positions.

Figure 7:
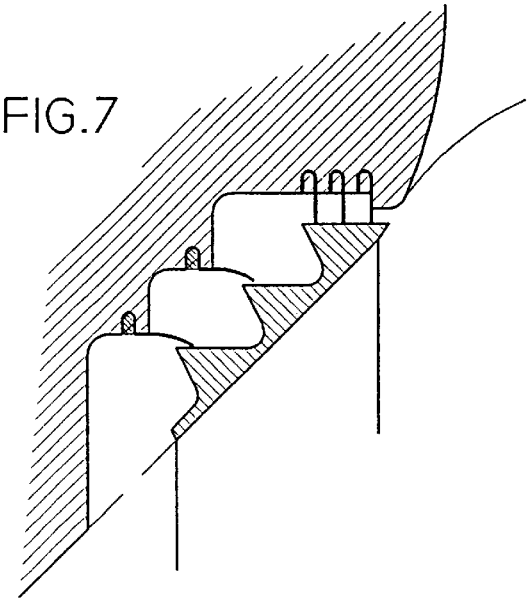
FIG. 7 shows a partial longitudinal section of the moving-blade tip of a stage having pronounced conicity with a shroud-plate embodiment variant.

Finally, FIG. 7 shows the novel solution in the case of a shroud plate having a conicity of about 45ø, as is used in the rear low-pressure stages of steam turbines. It can be seen here that, even in the case of such extreme duct openings, the solution according to FIG. 4 can be readily applied. In addition, this solution offers the advantage that the above-described kink angle B at the inlet, which kink angle B is directed radially inward and is fluidically harmful per se, can be avoided. That is to say, the shroud-band contour corresponds here to the duct contour predetermined overall.

Compared with the prior art, all the solutions shown and described thus far have the advantage that, as a result of the stepped arrangement and in particular the sloping radial parts, a substantially increased sealing length is available. In addition, at least the shroud plates according to FIGS. 4, 6 and 7 also have smaller shroud-plate masses.

Obviously, numerous modifications and variations of the present invention are possible in light of the above teachings. It is therefore to be understood that, within the scope of the appended claims, the invention may be practiced otherwise than as specifically described herein.

What is claimed as new and desired to be secured by Letters Patent of the United States is:

1. A device for sealing a gap between at least one moving blade and a stator of a turbomachine, comprising:

said stator having a conical contour and including at least one cavity;

at least one encircling shroud plate disposed at a distal end of said at least one moving blade, said at least one shroud plate projecting towards said at least one cavity of said stator and making a seal against said stator, said at least one shroud plate being stepped in configuration;

sealing strips disposed on said stator, each said sealing strip acting on said stepped at least one shroud plate and enclosing a vortex chamber;

an axially extending labyrinth inlet located between said at least one shroud plate and said at least one cavity of said stator, wherein said at least one cavity of said stator is contoured at said labyrinth inlet to include a recessed portion and a toothed portion projecting outward, said at least one shroud plate being provided with a recess which corresponds to a shape of said toothed portion of said at least one cavity; and a curved sealing strip disposed between said recess of said at least one shroud plate and said at least one cavity in a substantially axial direction.

2. The device of claim 1, wherein surfaces of said steps of said at least one shroud plate are directed radially outward to slope against a direction of flow.

3. The device of claim 1, wherein an inner, flow-limiting wall of said at least one shroud plate at a rear edge of said at least one moving blade is provided with a kink angle (A) directed radially outward.

* * * * *